US011090548B2

(12) United States Patent
Goverud-Holm et al.

(10) Patent No.: US 11,090,548 B2
(45) Date of Patent: Aug. 17, 2021

(54) MOVING MECHANISM FOR A SKI BINDING

(71) Applicant: ROTTEFELLA AS, Klokkarstua (NO)

(72) Inventors: Thomas Goverud-Holm, Hoff (NO); Oyvar Svendsen, Oslo (NO); Jorn Frode Danielsen, Drobak (NO); Magnus Anderssen, Nesoddtangen (NO)

(73) Assignee: ROTTEFELLA AS, Klokkarstua (NO)

( * ) Notice: Subject to any disclaimer, the term of this patent is extended or adjusted under 35 U.S.C. 154(b) by 19 days.

(21) Appl. No.: 16/618,209

(22) PCT Filed: Nov. 22, 2017

(86) PCT No.: PCT/NO2017/050301
§ 371 (c)(1),
(2) Date: Nov. 29, 2019

(87) PCT Pub. No.: WO2018/222044
PCT Pub. Date: Dec. 6, 2018

(65) Prior Publication Data

US 2020/0179790 A1 Jun. 11, 2020

(30) Foreign Application Priority Data

May 30, 2017 (NO) ..... 20170891

(51) Int. Cl.
*A63C 9/00* (2012.01)
*A63C 9/086* (2012.01)
*A63C 9/20* (2012.01)

(52) U.S. Cl.
CPC ..... *A63C 9/005* (2013.01); *A63C 9/0053* (2019.05); *A63C 9/086* (2013.01); *A63C 9/20* (2013.01); *A63C 2009/008* (2013.01)

(58) Field of Classification Search
CPC ..... A63C 9/005; A63C 2009/008
See application file for complete search history.

(56) References Cited

U.S. PATENT DOCUMENTS

2006/0103113 A1 5/2006 Guyot et al.
2008/0002998 A1 1/2008 Goto et al.
2015/0265905 A1 9/2015 Thomas et al.

FOREIGN PATENT DOCUMENTS

CN 101772365 A 7/2010
CN 102159288 A 8/2011
(Continued)

OTHER PUBLICATIONS

International Search Report PCT/ISA/210 for International Application No. PCT/NO2017/050301 dated Mar. 14, 2018.
(Continued)

*Primary Examiner* — James A Shriver, II
*Assistant Examiner* — Michael T. Walsh
(74) *Attorney, Agent, or Firm* — Harness, Dickey & Pierce, P.L.C.

(57) ABSTRACT

A ski binding moving mechanism (1) comprising:—a ski binding (2*a*) configured to be fastened in the vertical and lateral direction on a ski, and further configured to be movable in the longitudinal direction relative to the ski; —a rod (5) with two or more pushing elements (51*a*, 51*b*, . . . ), the rod (5) being fastened to the ski binding (2*a*); and—a rotatable element (32), configured to be fastened fixedly relative to the ski in the longitudinal direction of the ski, the rotatable element (32) being rotatable relative to the ski (6), wherein the rotatable element (32) comprises:—a first and a second rotating pin (321, 322) configured to rotate with the rotatable element (32), and cooperate with the pushing elements (51*a*, 51*b*, . . . ), wherein—the rotatable element (32) is configured to be rotated at least one revolution and move the rod (5) and the binding (2*a*) in the same longitudinal direction throughout the revolution.

17 Claims, 11 Drawing Sheets

(56) References Cited

FOREIGN PATENT DOCUMENTS

| | | | |
|---|---|---|---|
| DE | 20001929 | U1 | 5/2000 |
| EP | 1226849 | A2 | 7/2002 |
| EP | 2624924 | A1 | 8/2013 |
| NO | 340839 | B1 | 6/2017 |
| WO | WO-2012/045723 | A1 | 4/2012 |
| WO | WO-2014/205472 | A1 | 12/2014 |
| WO | WO-2015/140258 | A1 | 9/2015 |

OTHER PUBLICATIONS

Norwegian Search Report for Norwegian Patent application No. 20170891 dated Dec. 22, 2017.

International Preliminary Report on Patentability PCT/IPEA/409 for International Application No. PCT/NO2017/050301 dated May 23, 2019.

English-language translation of Chinese Office Action dated Apr. 23, 2021 for corresponding Chinese Application No. 201780091362.8.

MOVING MECHANISM FOR A SKI BINDING

CROSS-REFERENCE TO RELATED APPLICATIONS

This application is a national phase under 35 U.S.C. § 371 of PCT International Application No. PCT/N02017/050301 which has an International filing date of Nov. 22, 2017, which claims priority to Norwegian Patent Application No. 20170891, filed May 30, 2017, the entire contents of each of which are hereby incorporated by reference.

TECHNICAL FIELD

The present invention relates to a system for optional dynamic positioning of a ski binding during use to improve a skier's performance and user experience.

BACKGROUND ART

It is already known that it can be advantageous to be able to change the position of a binding on a ski in order to improve the skier's performance and user experience. By moving the binding forward in relation to a neutral position, the skier will notice that the grip on the surface is better. This is due first and foremost to it being easier for the skier to press the ski's wax zone down on the surface. By moving the binding backwards on the ski relative to a neutral position, the grip will become poorer, but the ski will glide more easily and faster.

WO2012045723A1 shows different embodiments of a ski binding that is adjustable in the longitudinal direction.

The front part of the binding, referred to as first unit 3, where the tip of the ski shoe is attached, is displaceably fastened in the longitudinal direction to a plate that is attached to the ski.

In FIG. 8, the second unit 4 is in this case equipped with a rotatable actuator 63 that can be rotated half a revolution between two positions, thereby enabling the first unit, and thus the ski shoe, to be moved between the two positions.

The rotatable actuator has a downward facing peripheral pin that grips a transverse slot 65 in a connecting means extending from the first unit, and is connected thereto. By turning the button, the pin will thus run in a semi-circular movement and force the binding forwards or backwards depending on the starting position.

In this case, the actuator moves together with the ski binding as the position is changed.

Norwegian Patent 340839B1 also teaches a ski binding that can be moved in the longitudinal direction.

Here too, a mounting plate is used with a rail that can move in the longitudinal direction of the plate, whilst it is held fixed by the plate in all other directions.

In this case, the actuator is fastened to the rail such that the binding moves relative thereto when its position is changed.

In FIG. 12 in NO340839, the actuator is shown as a rotary wheel secured in a housing, which is turn is fastened to the mounting plate. When the rotary wheel is turned in one or other direction, the binding is moved forwards and backwards.

BRIEF SUMMARY

The invention is in an embodiment 1 a ski binding moving mechanism (1) as defined in independent claim 1.

The ski binding can be moved in a longitudinal direction by rotating the rotatable element, and the rotatable element can be rotated at least one revolution.

The rotatable element is fixed relative to the ski. This gives a simple and ergonomic solution in relation to where the rotatable element is moved back and forth as a result of it being rotated or operated in another way.

Use of rotating pins means that a large moment can be obtained on the rail by rotating the rotatable element, which also means simple operation, whilst the displacement of the binding can be spread over a desired rotation, e.g., one and a half revolutions between the forward and the rear position.

The rotating pins allow a quick and effortless movement of the binding, which is desirable in order to obtain a desired effect with a view to changing the grip and glide properties of the ski.

The rod that is fastened to the binding is locked in the longitudinal direction when both the first and the pin are aligned with the rotational axis of the rotatable element. Longitudinal forces from a skier who exerts a force forwards or backwards on the binding and further to the rod will thus not be converted into rotation of the rotatable element, as there is no lever arm in this position.

A fixed position can thus be defined for each time the rotatable element is rotated a half revolution, and the ski binding can therefore be moved between several positions.

The present invention gives an advantageous speed variation of the rod during the moving movement. If the rotatable element is rotated at a steady speed, the rod will be moved relatively more slowly in proximity to each defined position than between these positions. I.e. that the speed of the rod is accelerated by turning from one position to the next, but only to the midpoint between these positions. After that, the speed is retarded towards the next position. This means that it is easy to align the pins in a chosen position, as the rod barely moves in precisely that area, and thus results in relatively larger moment.

In an embodiment, the pushing elements (51*a*, 51*b*, . . . ) are arranged one after another, where the first and the second rotating pin (321, 322) are arranged to alternately push the pushing elements (51*a*, 51*b*, . . . ), and thus the rod (5), in the same longitudinal direction when the rotatable element (32) is rotated.

The rotating movement is thus converted into a longitudinal movement and force that are not limited by the radius of the rotatable element.

EMBODIMENTS OF THE INVENTION

In the following section of the description, different examples and embodiments of the invention are shown to give the skilled artisan a more detailed understanding of the invention. The specific details that are associated with the different embodiments and with reference to the attached drawings should not be understood as limiting the invention. The scope of protection of the invention is defined by the accompanying patent claims.

The embodiments are numbered here to give a good understanding of what each one includes. In addition, a number of dependent embodiments are described, called associated embodiments, which are defined in relation to the numbered inventions. Unless otherwise specified, an embodiment that is dependent upon a numbered embodiment, is capable of being combined directly with the referred embodiment or any of its associated embodiments.

An embodiment 1 of the ski binding moving mechanism (1) according to the invention will now be explained with reference to FIGS. 2, 11 and 12. In this embodiment, the ski binding moving mechanism (1) comprises a ski binding configured to be moved in the longitudinal direction relative to the ski.

It further comprises a rod (5) with two or more pushing elements (51*a*, 51*b*, . . . ), the rod (5) being fastened to the ski binding (2*a*), and a rotatable element (32) configured to be fixedly fastened relative to the ski in the longitudinal direction of the ski, the rotatable element (32) being rotatable relative to the ski.

Figure 6:
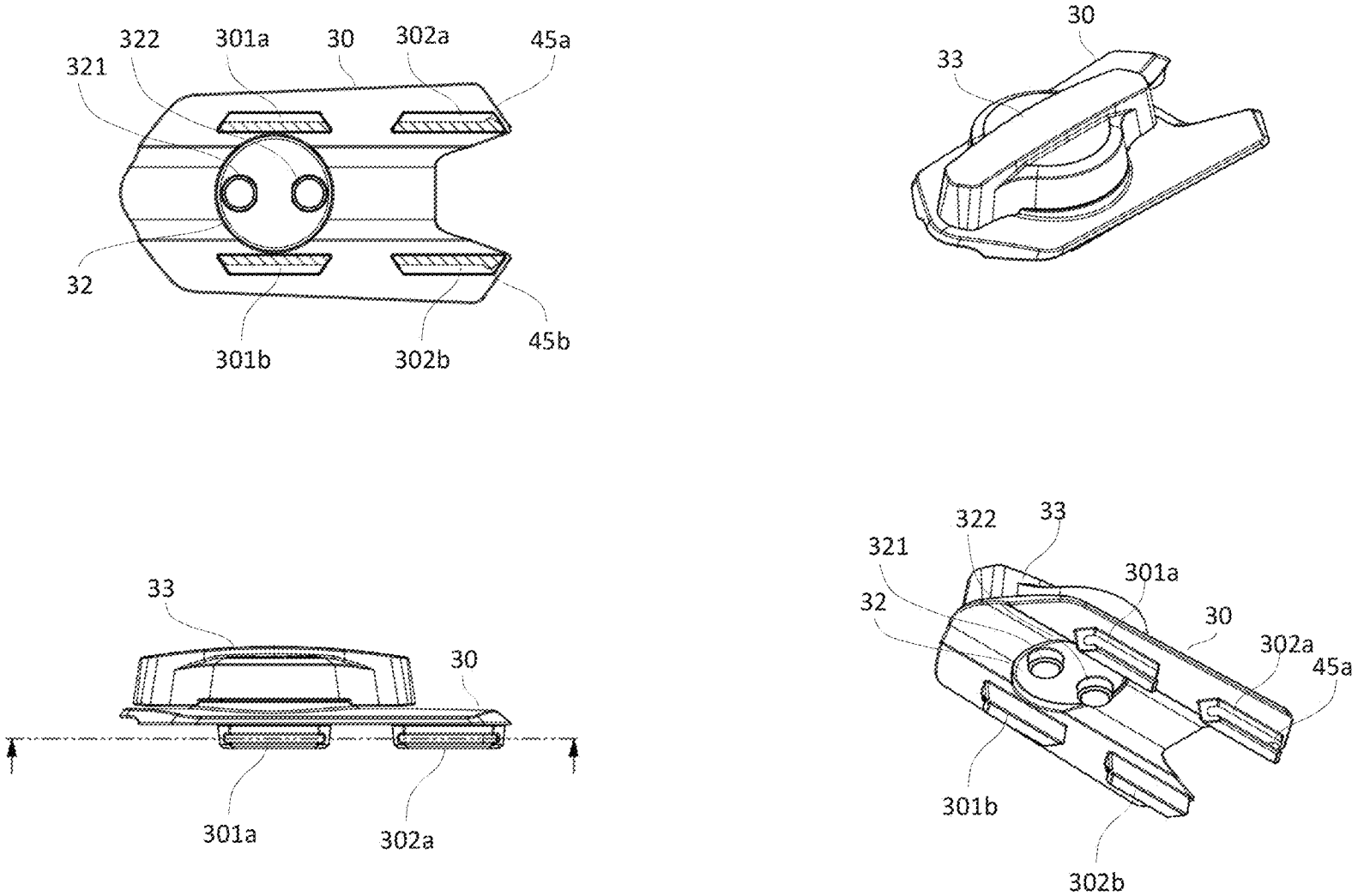

The rotatable element (32) comprises a first and a second rotating pin (321, 322), as shown in FIG. 6, and which are arranged to rotate with the rotatable element (32), and to cooperate with the pushing elements (51*a*, 51*b*, . . . ).

Both the rotatable element (32) and the first and the second rotating pin (321, 322) are configured to be rotated at least one revolution and move the rod (5) and the binding (2*a*) in the same longitudinal direction throughout the revolution.

In an associated embodiment, which can be combined with the embodiment above, the ski binding is configured to be capable of being mounted fastened in a lateral direction and/or a vertical direction relative to the ski.

In an associated embodiment, which can be combined with embodiment 1, or the associated embodiment, the rotatable element (32) is configured to be rotated at least one and a half revolutions and push the rod (5) in the same longitudinal direction throughout the revolutions.

The ski binding shown here is an NNN toe binding suitable for cross country skiing, but the invention can be used to move any type of binding providing the rod and the binding are complementary, i.e. are made to be fastened together. Thus, other binding types used in other skiing disciplines can also benefit from the advantages of the invention in cases where it is desirable to have a binding that can be moved in the longitudinal direction, e.g. telemark, randonnee etc.

In an embodiment 2, which can be combined with embodiment 1, the pushing elements (51*a*, 51*b*, . . . ) are arranged one after another in the longitudinal direction of the rod.

In a first associated embodiment, the first and the second rotating pin (321, 322) are arranged to alternately push the pushing elements (51*a*, 51*b*, . . . ), and thus the rod (5), in the same longitudinal direction when the rotatable element (32) is rotated.

In a second associated embodiment, which can be combined with embodiment 2 or the first associated embodiment, which can be explained with reference to FIG. 3, an example is shown of how the first and the second rotating pin (321, 322) cooperate with the pushing elements (51*a*, 51*b*, . . . ), such that the rod can be pushed in the longitudinal direction. A displacement sequence with five positions (P1-P5) is illustrated in this figure.

As described earlier, the first and the second rotating pin (321, 322) are arranged to rotate with the rotatable element (32), which is indicated as a broken circle in this instance, such that the pins (321 and 322) are visible. However, the rotatable element (32) may have other types of shapes without this being of consequence for the invention. The pins are indicated as a solid circle and an open circle merely to show their relative position in the sequence that is to be described.

In the first position (P1), the rod (5) and thus a ski binding (2*a*, 2*b*) on the rod (5) are in the rearmost position relative to the mounting rod and the ski. These are not shown in the figure, but for illustration of the further positions in the sequence, it is important to understand that the rotatable element (32) is fixed relative to the longitudinal direction of the mounting plate (6) and the ski.

The first pin (321) here is in front of the first pushing element (51*a*), whilst the second pin (322) is between the first and the second pushing element (51*a*, 51*b*).

In the next position (P11), the rotatable element (32) has been rotated anticlockwise about 45 degrees, and the rod (5) has been pushed a short distance forward because the second pin (322) has moved forward and to the right as a result of the rotary movement, as illustrated by the black and white arrow. Due to the forward movement of the second pin (322) whilst it abuts against the rear of the first pushing elements (51*a*), it thus forces the rod (5) forward.

In the subsequent position (P12), this becomes even clearer. Here, the rotatable element (32) has been rotated anticlockwise about 90 degrees, and the rod (5) has been pushed a little further forward because the second pin (322) has moved even further forward and to the right as a result of the rotary movement.

In the next position (P13), the rotatable element (32) has been rotated anticlockwise about 135 degrees, and the rod (5) has been pushed a little further forward. Now, however, the second pin (322) has moved forward and to the left since the previous position (P12).

In position 2 (P2), the rotatable element (32) has been rotated anticlockwise about 180 degrees, and the rod (5) has been pushed a little further forward. The second pin (322) has moved forward and to the left since the previous position (P13), and has continued to push the first pushing element (51*a*) and the rod (5) forward.

In position 2 (P2), the second pin (322) is still located between the first and the second pushing element (51*a*, 51*b*), whilst the first pin (321), which to begin with was in front of the second pin (322), is now behind the second pin (322), more precisely between the second and the third pushing element (51*b*, 51*c*).

Another way of explaining how the rod (5) is pushed forwards, is to look at it as though the pins (321, 322) climb backwards on the pushing elements (51*a*, 51*b*, . . . ) when the rotatable element (32) is rotated anticlockwise. As the rotatable element (32) is fixed in the ski, the rod (5) must be pushed forward. The rod is during the half revolution pushed forward a length L1, as shown in the figure.

In position 2 (P2), as previously mentioned, the rotatable element has been rotated about 180 degrees, or a half revolution. However, it is possible to continue the rotary movement if it is desired to push the rod (5) and the binding (2) even further forward.

Figure 3:
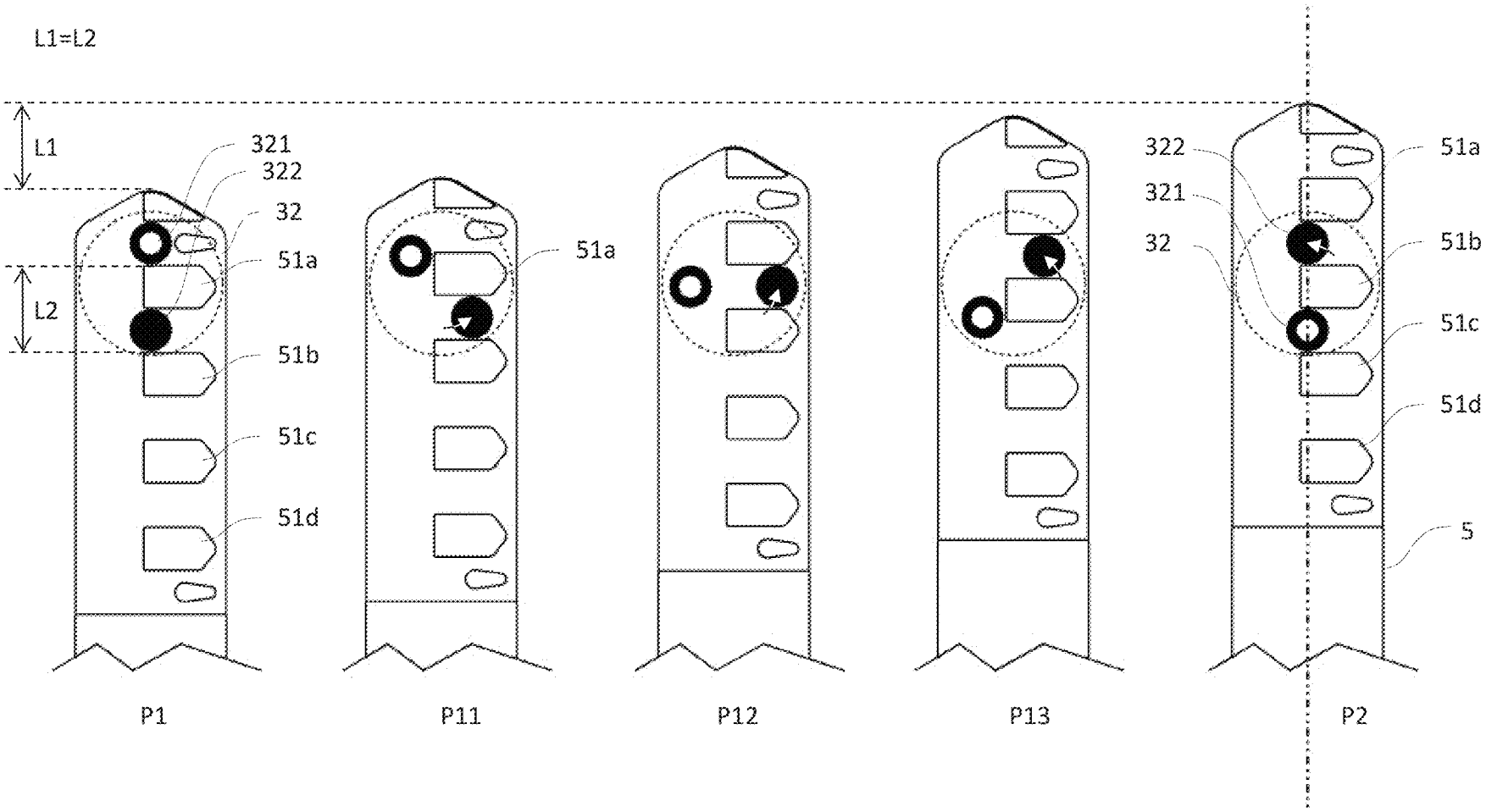
FIGS. 3 and 4 illustrate the principle used to move the rod (5) forward with the aid of the two pins (321, 322).

Although it is not illustrated in FIG. 3, the skilled artisan will understand that a continued rotation of the rotatable element (32) anticlockwise in FIG. 3, starting from position 2 (P2), will result in the first pin (321) now beginning to push on the rear of the second pushing element (51*b*) in the same way as the second pin (322) in the previous half revolution pushed on the rear of the first pushing element (51*a*). During the next half revolution in the same direction, the rod (5) will thus be pushed forward another a length L1, to a position 3 (P3), not shown in FIG. 3, where the second pin (322) is now located between the third and the fourth pushing elements (51*c*, 51*d*).

In position 3 (P3), it will still be possible to rotate the rotatable element (32) anticlockwise. After another half revolution, the rod (5) is in a position 4 (P4), not shown in FIG. 3, where the first pin (321) is behind the fourth pushing element (51*d*).

In the embodiment of the rod shown in FIG. 3, there are now no more pushing elements on which the pins can climb, so further advance of the rail (5) and the binding (2) is not possible in this case. Position 1 is thus a rear position and position 4 is a forward position, where the rod is pushed forward a length L1 for each half revolution and the total advance from the rear to the forward position is 3×L1. In addition to the rear and the forward position, position 1 and 4 (P1, P4), there are the two intermediate positions, position 2 and 3 (P2, P3).

Figure 7:
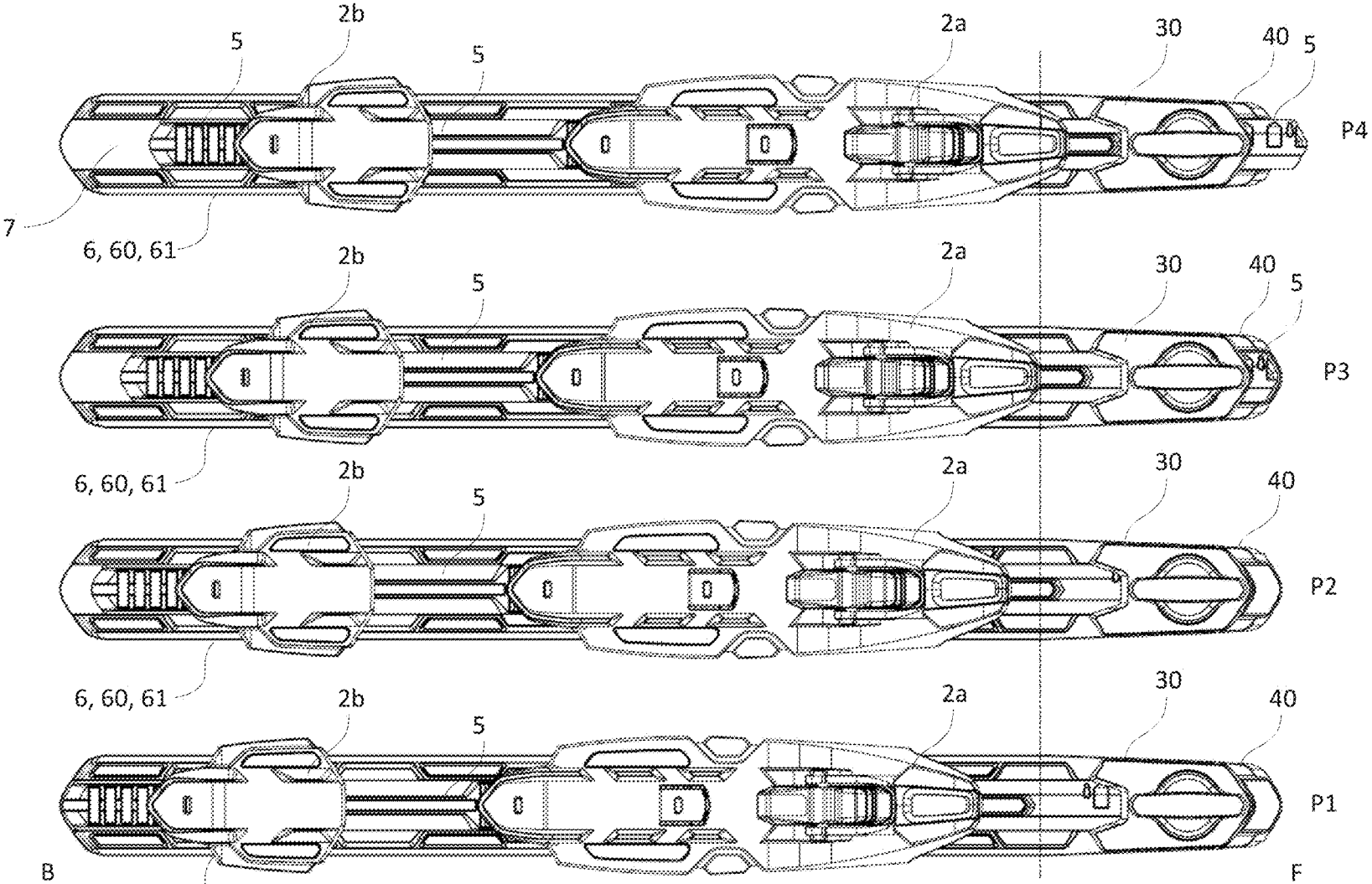
FIG. 7 illustrates how a ski binding (2*a*, 2*b*) can be moved between different positions in relation to the mounting plate.

In an embodiment 3, which can be combined with any of the embodiments above, and which further is illustrated in FIG. 7, a binding (2*a*, 2*b*) that is fastened to the rod (5) can be moved between the rear position, position (P1) to the forward position, position 4 (P4) via the intermediate positions, position 2 and 3 (P2, P3). It is worth noting that the rotatable element is displaced 180 degrees between each of the positions, i.e. a total of 540 degrees between the forward and the rear position.

In an embodiment 4, which can be combined with all the embodiments above and any of their associated embodiments, a neutral position is defined on the ski for the placement of the ski binding on the ski and the other positions are defined relative thereto.

FIG. 7 shows an example of this, where position 3 (P3) is defined as a neutral position, indicated by the vertical line ahead of the binding. There is thus a position, position 4 (P4) in front of the neutral position, and two positions, positions 1 and 2 (P1, P2) behind the neutral position.

In embodiment 5, which can be combined with any of the embodiments above and any of their associated embodiments, the pushing elements (51*a*, 51*b*, . . . ) have an extent (s1) in the longitudinal direction of the rod, and where the distance (s2) between the first and the second rotating pin (321, 322) is essentially the same as the extent (s1).

This means that the rod (5) will be determined by the position of the rotatable element (32), without any significant play in any direction.

However, the ratio between the diameter (d1) of the pins and the extent of the pushing elements in the longitudinal direction (s1) can vary. E.g. the ratio may be 1:10. However, the extent (s1) of the pushing elements can be limited by available width. E.g. an extent (s1) of 40 mm will mean that the distance between the pins must also be 40 mm, and the rotatable element will thus have an extent of at least 40 mm plus twice the diameter (d1) of the pins. It will normally not be desirable that the rotatable element should extend beyond the width of the mounting plate (6) or the ski width.

The ratio between the extent (s1), the distance between the pushing elements (s2) and the diameter (d2) of the pins will normally be determined by how long a step it is desired that the rod (5) should be movable at a time, whilst it is desired to keep the size of the rotatable element (32) within certain limits. The moment required to rotate the rotatable element is also of significance. The moment increases with increasing distance between the pins and increasing diameter of the pins. Large distance will thus be capable of being offset by thin pins, as thin pins lead to a larger displacement of the rod (5).

In an embodiment 6, which can be combined with any of the embodiments above, the pushing elements (51*a*, 51*b*, . . . ) can have an extent (s1) that is essentially equal to the diameter of the first and the second pin (321, 322).

In embodiment 7, which can be combined with any of the embodiments above, the first and the second pin (321, 322) are cylindrical.

In embodiment 8, which can be combined with any of the embodiments above, the first and the second pin (321, 322) are rotatably fastened to the rotatable element (32). E.g., the ski binding moving mechanism can comprise bearings that are fastened to the rotatable element (32) and to which the pins (321, 322) are fastened.

Figure 4:
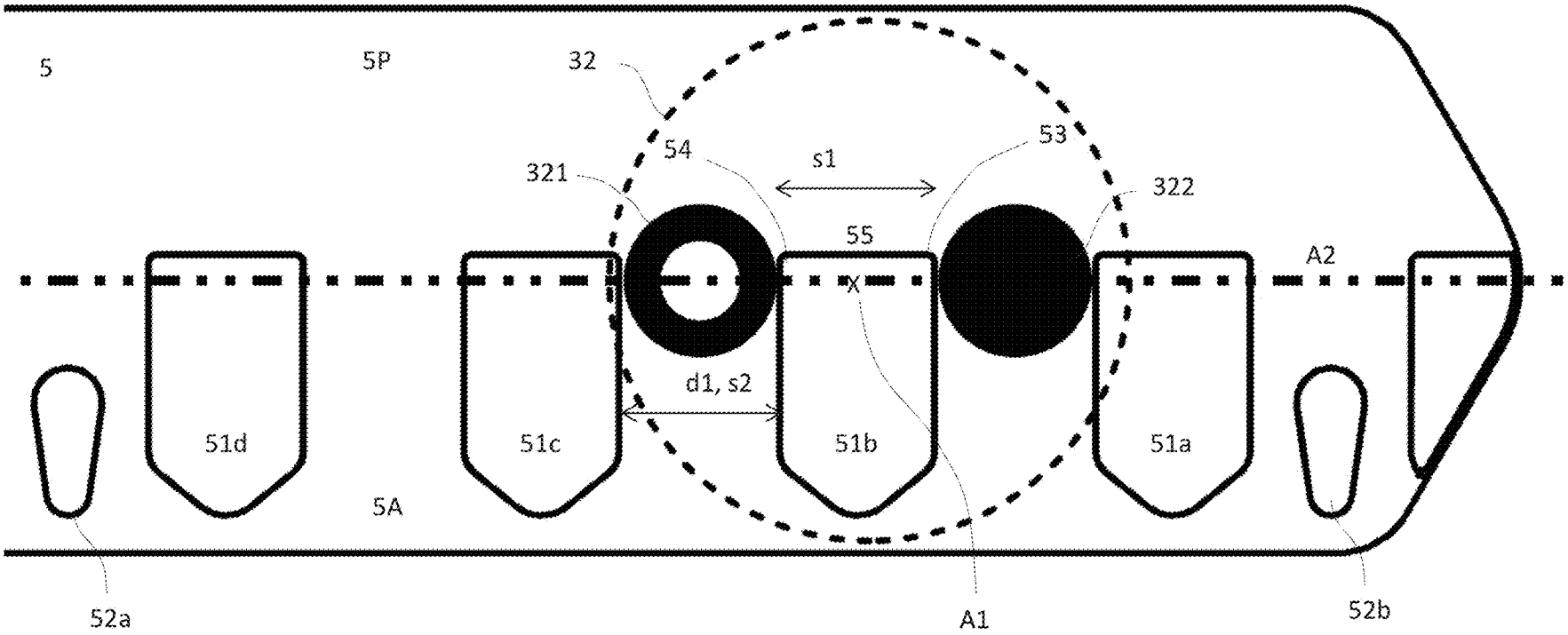
Figure 5:
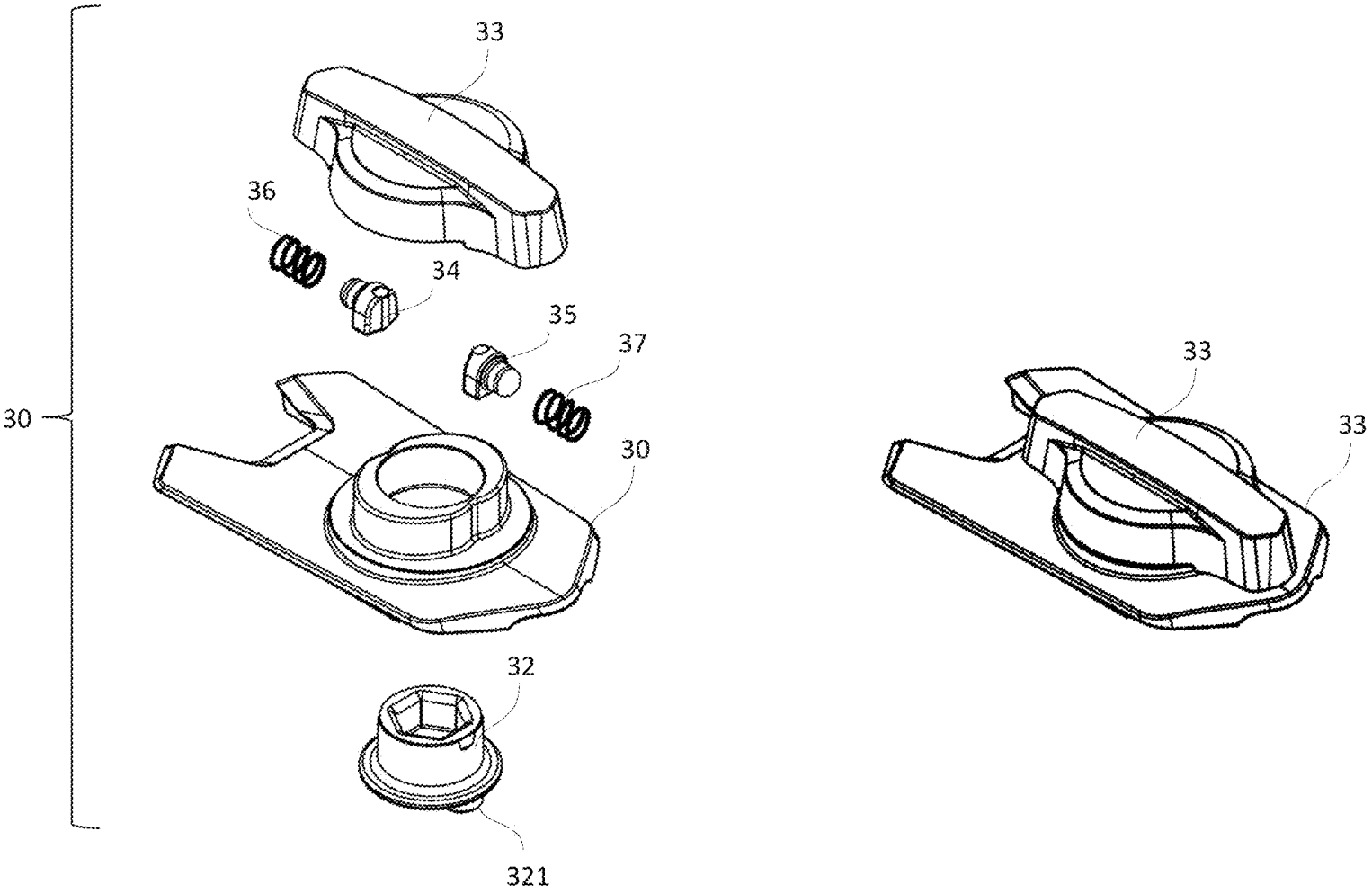
FIGS. 5 and 6 show an embodiment of the fastening element (30).

In a first embodiment 9, which can be combined with any of the embodiments above, the rotatable element (32) is configured to rotate about an axis of rotation (A1) as illustrated in FIG. 4.

In a first associated embodiment, which can be combined with the embodiment above, the axis of rotation (A1) is halfway between the first and the second pin (321, 322).

In a second associated embodiment, which can be combined with embodiment 9 above and the first associated embodiment, the pushing elements (51*a*, 51*b*, . . . ) are arranged non-symmetrically relative to a longitudinal axis (A2) that intersects the axis of rotation (A1), such that the major part of the width of each pushing element (51*a*, 51*b*, . . . ) is on one and the same active side (5A) of the longitudinal axis (A2), and where the opposite side of the longitudinal axis is the passive side (5P).

In an embodiment 10, which can be combined with any of the embodiments above, and any of their associated embodiments, the rod (5) has at least one stop element (52*a*, 52*b*) configured to prevent rotation of the rotatable element (32).

Examples of stop elements (52*a*, 52*b*) are shown in FIG. 4. Here there is a rear stop element (52*a*) arranged behind the rearmost pushing element (51*d*) and a forward stop element (52*a*) arranged ahead of the foremost pushing element (51*a*). The first or second pin (321, 322) will on minimum or maximum movement of the rod (5) abut against the stop elements (52*a*, 52*b*) such that further rotation is not possible.

When there is an even number of pushing elements (51*a*, 51*b*, . . . ) as illustrated, it will always be the first or second pin that strikes both stop elements (52*a*, 52*b*), depending on the starting position.

The stop element (52*a*, 52*b*) can in an associated embodiment be arranged on the active side (5A).

In an embodiment 11, which can be combined with any of embodiments 9 to 10 above and any of their associated embodiments, the ski binding moving mechanism (1) comprises a force-actuated lock configured to lock the rod (5) in the longitudinal direction when the first and the second rotating pin (321, 322) are aligned with the longitudinal axis (A2), and to disengage when the rotatable element (32) has applied thereto a rotational force that is greater than the rotational force necessary to rotate the rotatable element (32) and thereby displace the rod (5) in an area where the first and the second rotating pin (321, 322) are not aligned with the longitudinal axis (A2).

In a first associated embodiment, which can be combined with the embodiment above, the pushing elements (51*a*, 51*b*, . . . ) have a first and a second corner (53, 54) on the passive side (5P).

In a second associated embodiment, which can be combined with the first associated embodiment above, the first and the second corner (53, 54) are a distance from the axis of rotation (A1) that is greater than half the extent (s1) of the pushing elements (51*a*, 51*b*, . . . ).

In a third associated embodiment, which can be combined with one of the two associated embodiments above, the pushing elements (51*a*, 51*b*, . . . ) have an edge (55) connecting the first and the second corner (53, 54) on the passive side (5P), where the edge (55) is essentially at a distance from the axis of rotation (A1) that is smaller than half the extent (s1) of the pushing elements (51*a*, 51*b*, . . . ), such that the first and the second pin (321, 322) can rotate unobstructed beyond the edge (55) between the corners (53, 54).

In an embodiment 12, which can be combined with any of embodiments 9 to 11 and any of their associated embodiments above, the pushing elements (51*a*, 51*b*, . . . ) have a tapering edge (56) on the active side (5A).

This is shown, e.g., in FIG. 4. If snow and ice should get into the binding, this shape will help to push the snow and ice out on the active side (5A) of the pins (321, 322).

In an embodiment 13, which can be combined with any of the embodiments above and any of their associated embodiments, the rod (5) comprises at least four pushing elements (51*a*, 51*b*, 51*c*, 51*d*).

Four pushing elements allow the rod (5) and the binding (2) to be adjusted into four different positions, and the rotatable element (32) can be rotated 540 degrees.

In an associated embodiment, the rod comprises 5, 6, 7, 8, 9 or 10 pushing elements.

For every pushing element that is added, the rotatable element (32) can be rotated a further half revolution and a new position is added. E.g. with seven pushing elements there will be seven positions which can be selected in the course of three revolutions.

In an embodiment 14, which can be combined with any of the embodiments above and any of their associated embodiments, the first and the second pin (321, 322) face down towards the mounting plate (6), and the pushing elements (51*a*, 51*b*, . . . ) face upwards from the rod (5).

However, the same effect can be achieved in that the assembly of pins and pushing elements is inverted such that the rod with downward facing pushing elements is uppermost and the pins are lowermost. Alternatively, the rod and the pins can be placed adjacent to one another, such that the pins and the pushing elements face laterally towards one another.

In an embodiment 15, which can be combined with any of the embodiments and their associated embodiments above, the ski binding moving mechanism (1) comprises an electric motor configured to rotate the rotatable element (32). The shaft of the electric motor can e.g.,have a pinion wheel that is engaged with external or internal teeth on the rotatable element (32).

A control unit and battery can be placed together with the electric motor, e.g. ahead of the mounting rod (6), or at other points on or in the ski, on the mounting plate (6) or on or in fastening element (30).

In an embodiment 16, which can be combined with any of the embodiments above and their associated embodiments, the ski binding moving mechanism (1) comprises a mounting plate (6) configured to be fastened to the ski and to the binding, where the binding (2*a*) is movable in the longitudinal direction.

Figure 1:
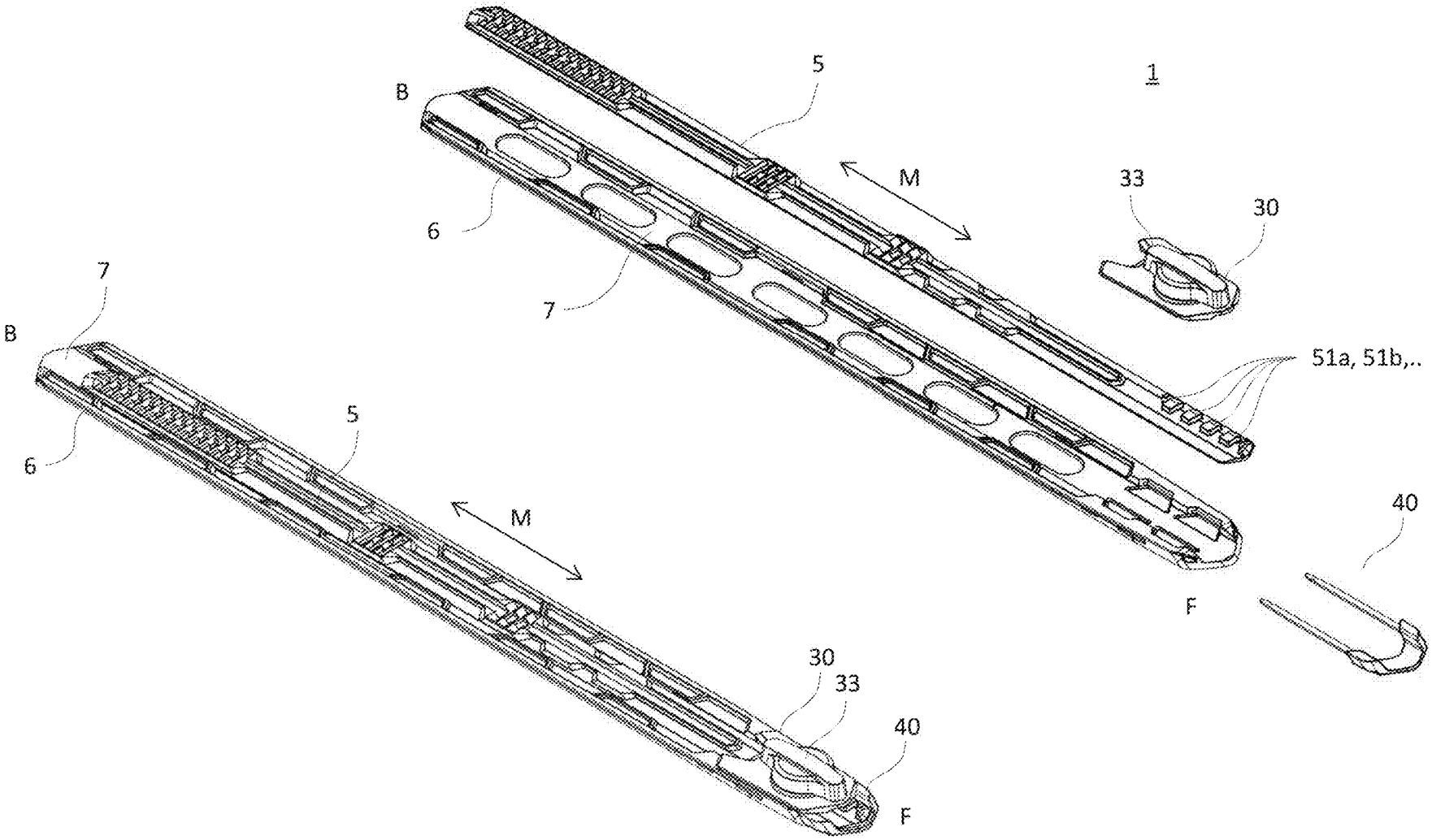
FIG. 1 shows an embodiment with a mounting plate (6) configured to be mounted on a ski, a rod (5) in the form of a rail configured to be fastened to a ski binding, or be part of a ski binding, a fastening element (30) and a vertical lock (40) that locks the fastening element (30) to the mounting plate (60). This is shown both assembled and in an exploded view.
Figure 2:
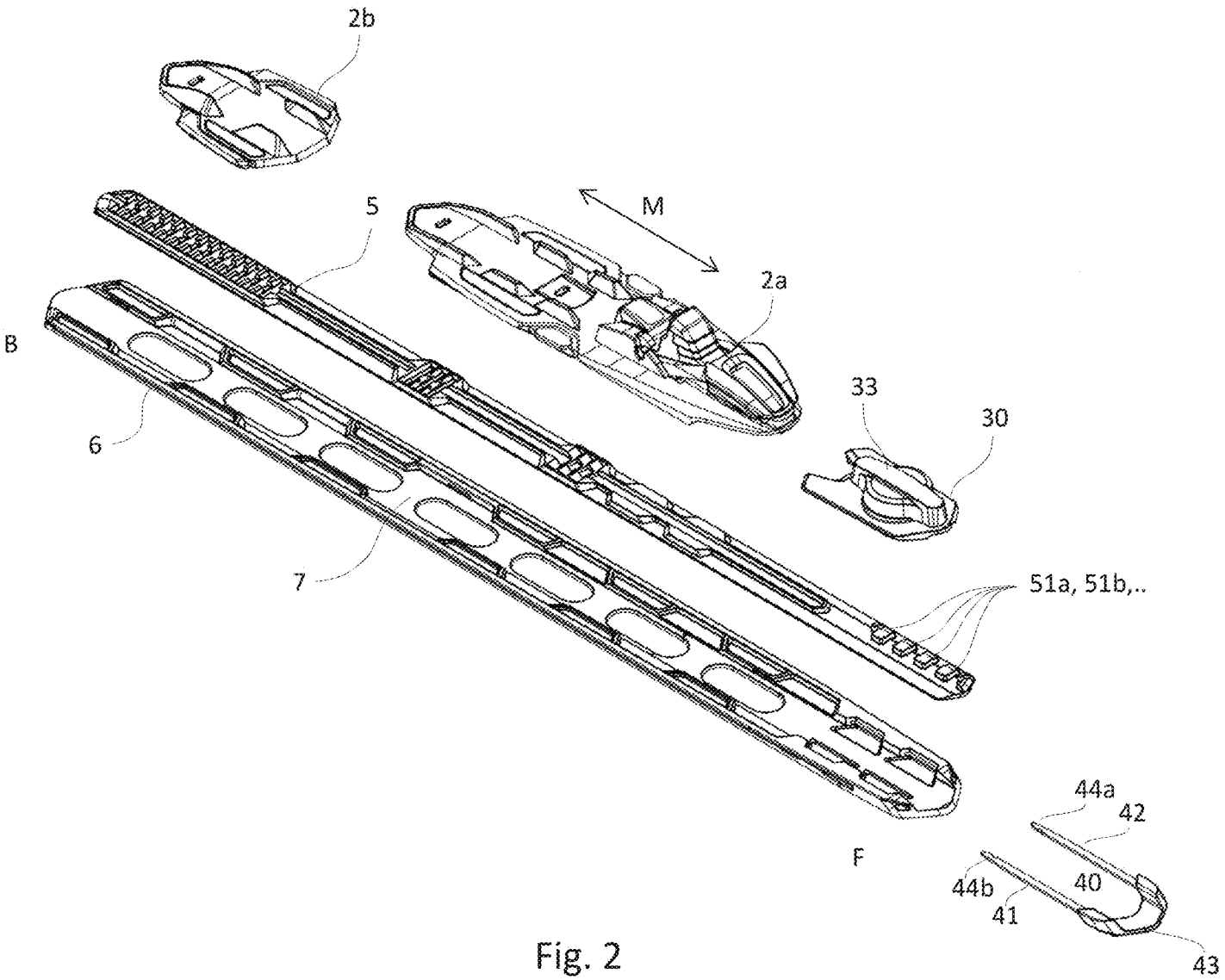
FIG. 2 is an exploded view of the same as in FIG. 1, but in addition shows a binding (2*a*, 2*b*) that is fastened to the rod (5).

The forward and rear part of the mounting plate (6) are labelled respectively F and B in FIGS. 1 and 2, and the longitudinal movement of the binding is indicated by the arrow M. By "same longitudinal direction" is meant forwards in the mounting plate or backwards in the mounting plate.

In an associated embodiment, which can be combined with the embodiment above, the rod (5) is configured to be arranged in a longitudinal groove (7) in the mounting plate (6), and to be capable of being moved in the longitudinal direction in the groove (7), as is illustrated in FIG. 1 by the arrow M that shows the relative movement of the rod (5) in relation to the mounting plate (6).

The rod (5) that is moved can either be a separate rod or rail, such as shown in FIG. 1, or an integral part of the ski binding (2).

In an embodiment 17, which can be combined with any of the embodiments above and any of their associated embodiments, the rod is a part of the ski binding (2*a*, 2*b*). This can be a toe binding (2*a*), a heel binding (2*b*), a combination of heel binding and a toe binding, or an integral binding for both heel and toe.

In an embodiment 18, which can be combined with any of the embodiments above, the ski binding (2*a*) is configured to be detachably fastened to the rod (5).

Figure 8:
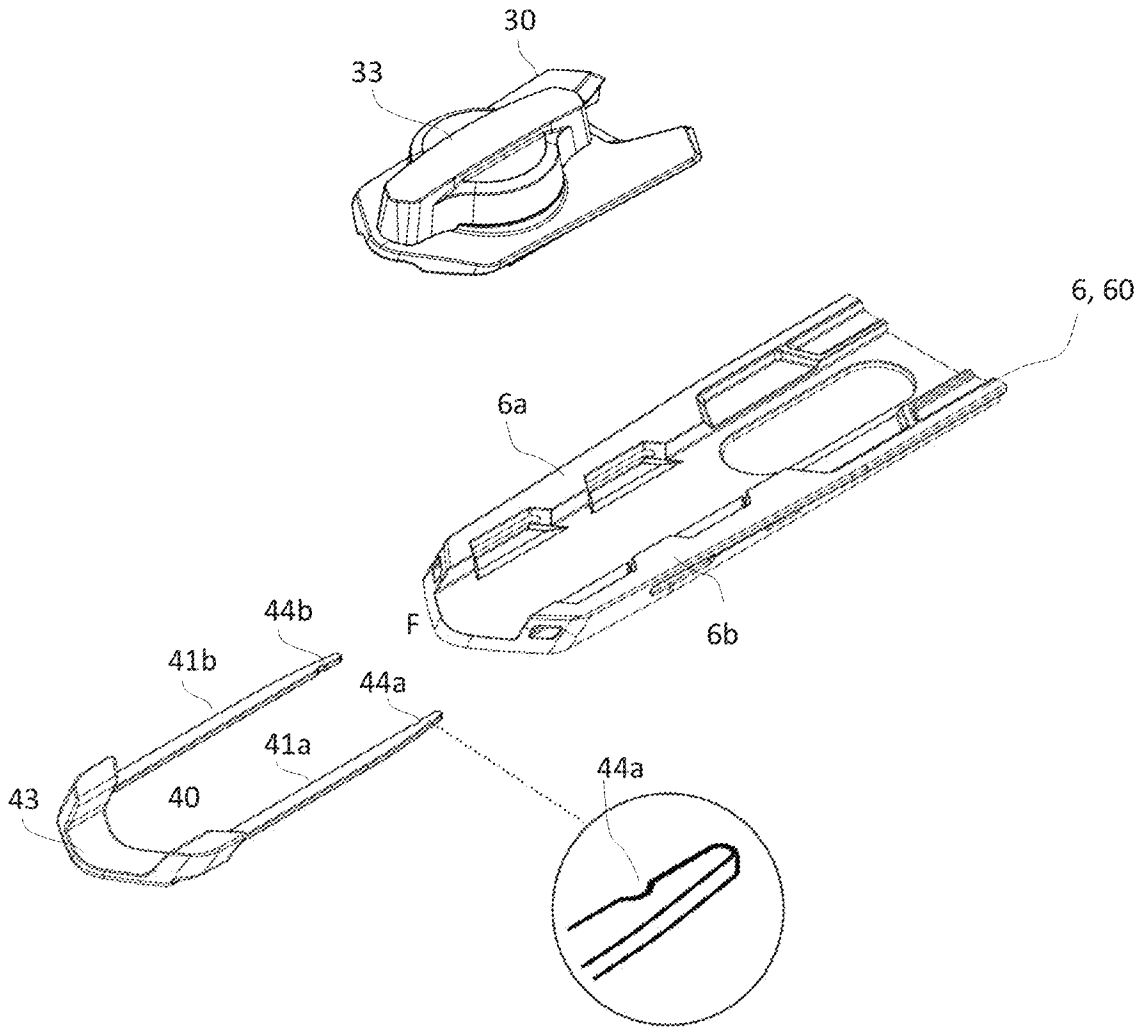
FIG. 8 shows some elements that may be incorporated in the ski binding mechanism where the fastening element (30) is detachable.
Figure 9:
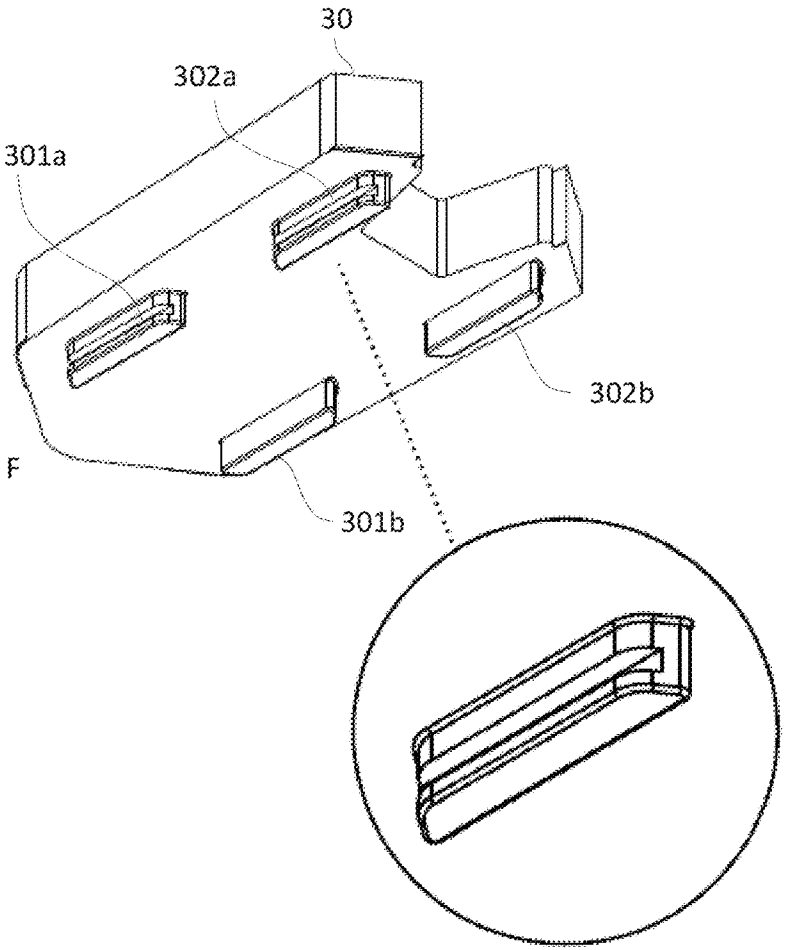
FIG. 9 shows, at the top right-hand side, an example of the forward part of a mounting plate (6), at the top right-hand side, an example of a fastening element (30) where one of the locking elements (302*a*) has been enlarged, and at the bottom left-hand side, the fastening element (30) placed down onto mounting plate (6). Here, a rod (5) has also been included in the form of a rail between the fastening element (30) and the mounting plate (6).
Figure 9:
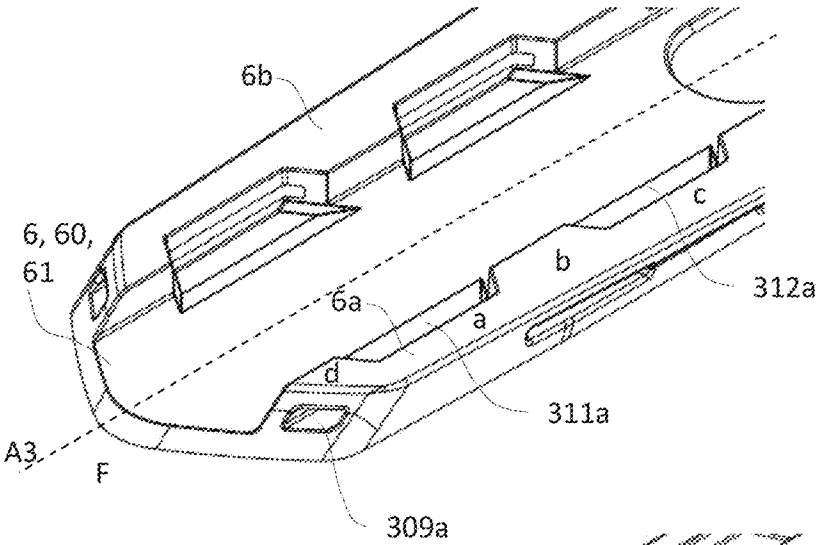
Figure 9:
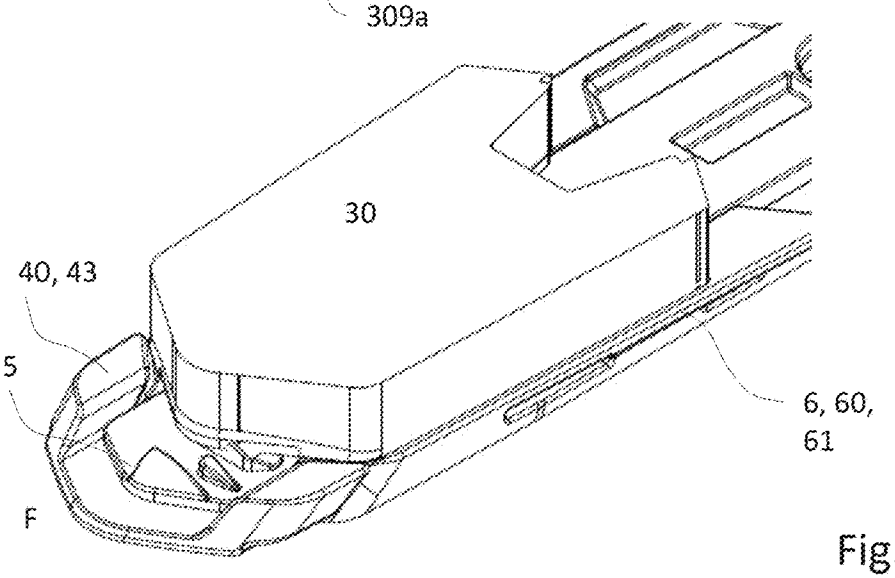
Figure 10:
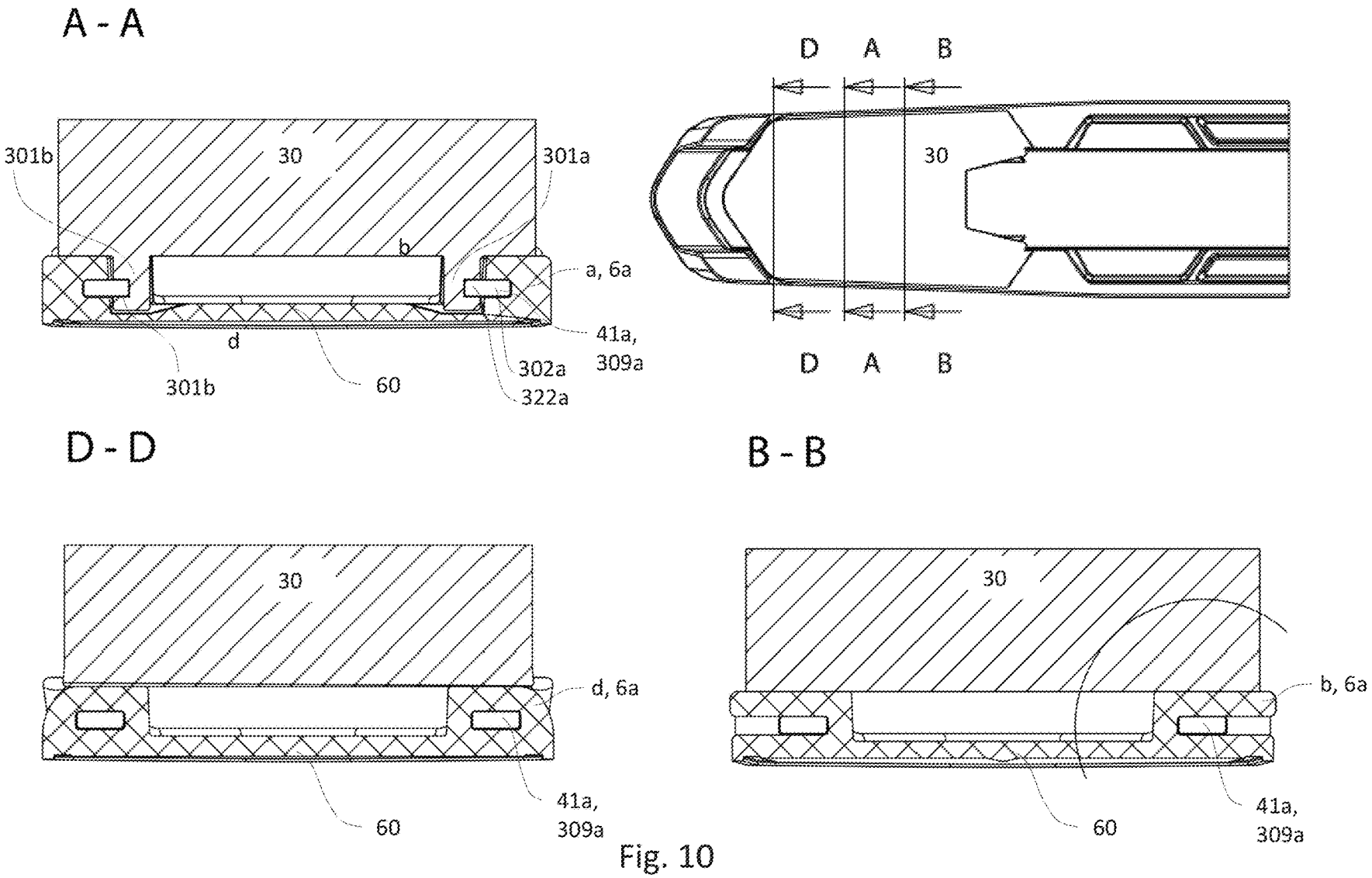
FIG. 10 shows three different cross-sections of a ski binding moving mechanism (1).

In an embodiment 19 which can be combined with any of the embodiments above, the ski binding moving mechanism (1) comprises a fastening element (30) configured to be mounted fastened relative to the ski, where the rotatable element (32) is fastened to the fastening element (30), as shown, e.g., in FIG. 8.

Figure 11:
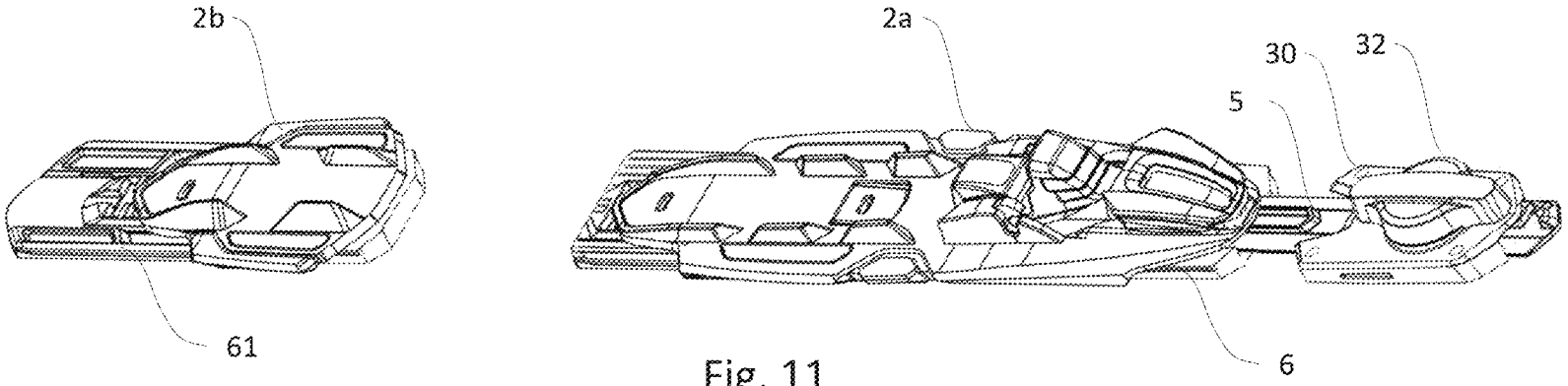
FIG. 11 shows an embodiment of the invention where the ski binding moving mechanism consists of a mounting plate (6) that is attached to the ski, and to which the binding (2*a*) is fastened. The fastening element (30) with the rotatable element (32) is fastened to the ski in front of the mounting plate (6). The rod (5) or the rod applies a longitudinal force on the ski binding (2*a*) when the rotatable element (32) is rotated. The heel plate (2*b*) is in this case fixedly mounted on a heel attachment plate (61) that can be attached to the ski.
Figure 12:
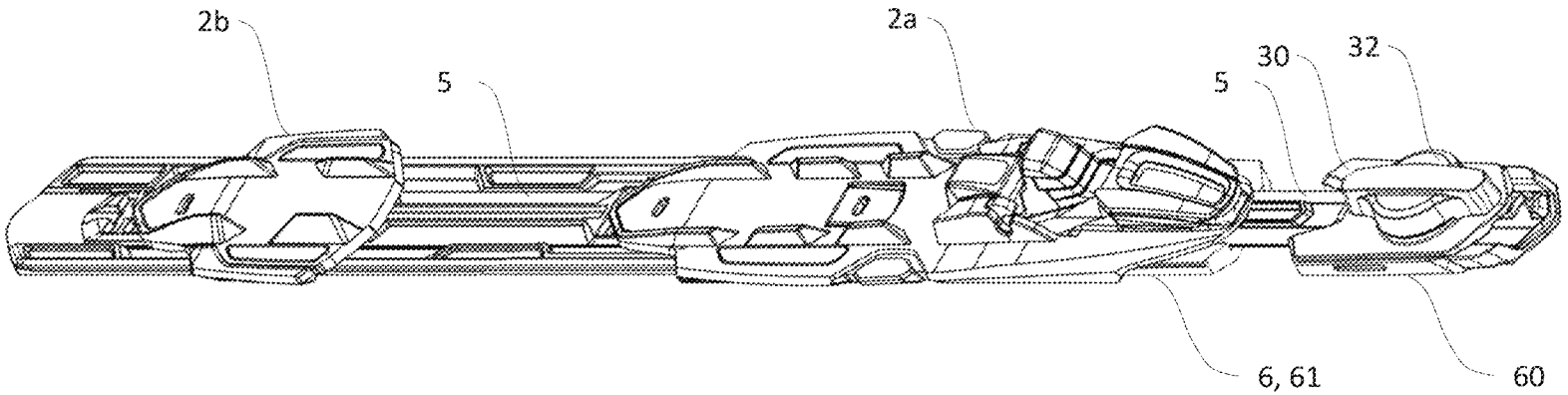
FIG. 12 shows an embodiment of the invention where the ski binding moving mechanism consists of a mounting plate (6) that is attached to the ski and to which the binding (2*a*) is fastened. The fastening element (30) with the rotatable element (32) detachably fastened to an attachment plate (60) that can be attached to the ski in front of the mounting plate (6). In the same way as above, the rod (5) or the rod applies a longitudinal force on the ski binding (2*a*) when the rotatable element (32) is rotated. The heel plate (2*b*) is in this case movably mounted on a heel attachment plate (61) that is integral with the mounting plate (6). The rod (5) is connected to the heel plate (2*b*) such that it moves together with the ski binding (2*b*).

In a first associated embodiment, the fastening element can be fastened to the ski, e.g., with glue or screws, indicated by circles that illustrate screw holes on top of the fastening element (30) in FIG. 11, or a combination of glue and screws. The fastening element can be split such that a lower part can be fastened to the ski before the rod or the rail is inserted, and an upper part in the form of a lid with the rotatable element (32) can be fastened to the top, either with throughgoing screws into the ski, or with an attachment mechanism to the lowermost part.

In a second associated embodiment, which can be combined with embodiment 18 above, the fastening element (30) is configured to be detachably mounted on a forward part of the attachment plate (60) that is configured to be fastened to the ski.

In a third associated embodiment which can be combined with the second associated embodiment above, the mounting plate (6) and the fastening element (30) have respectively one or more first locking elements (301*a*, 302*a*) and one or more second locking elements (311*a*, 312*a*), where the first locking elements (301*a*, 302*a*) and the second locking elements (311*a*, 312*a*), engage with one another and lock the fastening element (30) in the longitudinal and lateral direction of the mounting plate (6) when the fastening element (30) is provided from above and down onto the mounting plate (6) as shown in FIG. 2. The rotatable element (32) or the hand grip (33) is not shown in this figure.

In a fourth embodiment, which can be combined with the third associated embodiment above, the first locking elements (301*a*, 302*a*) are projecting elements that extend out from respectively the fastening element (30) and the second locking elements (311*a*, 312*a*) are opposing constrictions or apertures in the mounting plate (6).

In a fifth embodiment, which can be combined with the embodiment above, the first locking elements (301*a*, 302*a*) are projecting elements that extend out from respectively the fastening element (30) and the second locking elements (311*a*, 312*a*) are opposing constrictions or apertures in the mounting plate (6).

In a sixth associated embodiment, which can be combined with the fourth or fifth associated embodiment above, the ski binding moving mechanism (1) is a vertical lock (40) configured to lock the first and the second locking elements (301*a*, 302*a*, 311*a*, 3112*a*) to one another in the vertical direction.

In a seventh associated embodiment, which can be combined with the sixth associated embodiment above, the vertical lock (40) comprises at least one pin (41*a*), or bayonet, configured to be mounted in the longitudinal direction of the mounting plate (6).

In an eighth associated embodiment, which can be combined with the seventh associated embodiment above, the attachment plate (60) has a longitudinal upwardly directed first edge (6*a*) on one side, the first edge (6*a*) has varying width such that a second area (a) of the first edge (6*a*) forms the second locking element (311*a*), the edge (6*a*) comprising at least one first area (d) adjacent to the second area (a), where the first area (d) is wider than the second area (a), and where the first area (d) has a longitudinal channel (309*a*) configured to receive the vertical lock (40).

In a ninth associated embodiment, which can be combined with the eighth associated embodiment above, the second area (a) and the first locking element (301*a*) both comprise adjacent longitudinal grooves (322*a*, 302*a*) in their side walls configured to form, together, an extension of the longitudinal channel (309*a*) when the fastening element (30) is arranged on the attachment plate (6).

In an embodiment 20, which can be combined with any of the embodiments above and their associated embodiments, the ski binding moving mechanism (1) comprises a hand grip (33) configured to turn the rotatable element (32).

One example of a hand grip (33) is shown in FIG. 6. Here, the hand grip is mounted together with the rotatable element (32), such that the rotatable element (32) will rotate together with the hand grip (33). The hand grip (33) may be elongate, as illustrated in the figures to show that it and the first and the second pin (321, 322) are aligned, and that the binding is thus in a locked position.

In an embodiment 21, which can be combined with any of the embodiments above, the ski binding moving mechanism (1) comprises spring-loaded elements (34, 35) which are configured to rotate the rotatable element (32) towards the closest locked position, i.e., when less than 90 degrees remains until the two pins are longitudinally aligned.

In an associated embodiment, which can be combined with embodiment 20 and any of its associated embodiments, the spring-loaded elements (34, 35) and associated springs (36, 37) are located inside the hand grip (33).

The fastening element (30) can in this embodiment comprise an upward projecting boss (38) that fits into a recess in the hand grip (33). The boss (38) has a gradually increasing radius from two points that lie on a line through the centre of the boss. The spring-loaded elements (34, 35) are pressed between the boss (38) and a fixed point inside the hand grip (33). The springs (36, 37) are thus compressed when the rotatable element (32) is turned out of the locked positioned, and is relatively less compressed when it is in the locked position, such that the spring-loaded elements (34, 35), and thus the hand grip seek towards the locked position.

In an embodiment 22, which can be combined with any of the embodiments above, the ski binding moving mechanism (1) comprises a heel plate (2*b*) fastened to a heel attachment plate (61) configured to be attached to the ski. This is illustrated in FIGS. 2, 7, 11 and 12.

FIG. 11 illustrates a first associated embodiment where the heel plate (61) is separate from the mounting plate (6). Alternatively, it can be attached directly to the ski without an intermediate plate, e.g., by a click lock, glue or screw connection in an associated embodiment where the heel plate is fixed.

In a second associated embodiment, the heel attachment plate (61) is integral with the mounting plate (6).

In a third associated embodiment, which can be combined with embodiment 21 or the first associated invention above, the heel plate (2*a*) is movable in the longitudinal direction relative to the heel attachment plate (61) and interconnected to the binding in the longitudinal direction, such that the heel plate (2*b*) is moved together with the binding (2*a*).

In a fourth associated embodiment, which can be combined with embodiment 22 or any one of the associated first and second embodiments above, the rod (5) is connected to the heel plate (2*b*). Examples of this are shown in FIGS. 2, 7 and 12.

In a fifth associated embodiment, the heel plate (2*b*) is detachable and adjustable relative to the rod (5) as is illustrated, e.g., in FIG. 7, where a pin in the heel plate can be secured in different notches placed one after another in the longitudinal direction to adapt the ski binding and heel plate to different shoe sizes.

In a sixth associated embodiment, the heel plate (2*b*) and the ski binding (2*a*) can be made in one piece, or fastened together, such that the heel plate always follows the ski binding. The rod (5) can thus be fixedly or detachably connected to the tip of the binding (2*a*), and no rail will be necessary for the heel plate to move. Optionally the attachment mechanism between the heel plate and the ski binding can be adjustable in the longitudinal direction such that it can be adapted to different shoe sizes.

In different embodiments, which can be combined with any one of the embodiments above where the relevant elements are defined, one or more of the mounting plate (6), attachment plate (60), heel attachment plate (61), binding (2*a*), heel plate (2*b*), fastening element (30) vertical lock (40), rod (5) and hand grip (33) are symmetrical about a longitudinal axis.

In the illustrated embodiments, which are examples of how the invention can be carried out, different features and details are shown in combination. Although a number of features are described as belonging to a particular embodiment, this does not necessarily mean that these features must be implemented together in all embodiments of the invention. Similarly, features that are described in different embodiments should not be regarded as excluding combinations with each other. A person of skill in the art will understand that embodiments comprising some of the features that are not specifically described together, but which are also not described as being excluded from being combined with each other, are a part of the invention. An explicit description of all embodiments will not contribute to the understanding of the inventive concept, and thus some of the combinations have been omitted to render the application simpler and shorter.

The invention claimed is:

1. A ski binding moving mechanism comprising:

a ski binding configured to be fastened in a vertical direction and a lateral direction to a ski, and further configured to be moved in a longitudinal direction relative to the ski;

a rod with two or more pushing elements, the rod being fastened to the ski binding; and a rotatable element configured to be fastened fixedly relative to the ski in the longitudinal direction of the ski, the rotatable element being rotatable relative to the ski, wherein the rotatable element comprises;

exactly two rotating pins, configured to rotate with the rotatable element, and cooperate with the pushing elements, wherein the rotatable element is configured to be rotated at least one revolution and move the rod and the ski binding in a same longitudinal direction throughout the revolution.

2. A ski binding moving mechanism according to claim 1, where the rotatable element is configured to be rotated at least one and a half revolutions and move the rod in the same longitudinal direction throughout the at least one and a half revolutions.

3. A ski binding moving mechanism according to claim 1, where the pushing elements are arranged one after another in a longitudinal direction of the rod, the two rotating pins being configured to alternately push the pushing elements, and thus the rod, in the same longitudinal direction when the rotatable element is rotated.

4. A ski binding moving mechanism according to claim 1, where the pushing elements have an extent in the longitudinal direction of the rod, and where a distance between the two rotating pins is essentially equal to this extent.

5. A ski binding moving mechanism according to claim 1, where the two rotating pins include a first pin and a second pin that are cylindrical.

6. A ski binding moving mechanism according to claim 1, where the two rotating pins include a first pin and a second pin, where the rotatable element has an axis of rotation halfway between the first pin and the second pin.

7. A ski binding moving mechanism according to claim 6, where the pushing elements are arranged non-symmetrically relative to a longitudinal axis that intersects the axis of rotation, such that a major part of a width of each pushing element is on one and the same active side of the longitudinal axis, and where an opposite side of the longitudinal axis is a passive side.

8. A ski binding moving mechanism according to claim 7, comprising a force-actuated lock configured to lock the rod in the longitudinal direction of the ski when the two rotating pins are aligned with the longitudinal axis, and disengage when the rotatable element has applied thereto a rotational force that is greater than a rotational force necessary to rotate the rotatable element and thus push the rod into an area where the two rotating pins are not aligned with the longitudinal axis.

9. A ski binding moving mechanism according to claim 8, where the pushing elements have a first corner and a second corner on the passive side.

10. A ski binding moving mechanism according to claim 9, where the first corner and the second corner are at a distance from the axis of rotation that is greater than half an extent of the pushing elements when the two rotating pins are aligned with the longitudinal axis.

11. A ski binding moving mechanism according to claim 9, where the pushing elements have an edge connecting the first corner and the second corner on the passive side, the edge essentially being at a distance from the axis of rotation which is less than half an extent of the pushing elements, thereby allowing the two rotating pins to rotate unobstructed beyond the edge between the first corner and the second corner.

12. A ski binding moving mechanism according to claim 1, comprising a mounting plate configured to be attached on a top of the ski, between the ski and the ski binding, where the ski binding is movable in a longitudinal direction relative to the mounting plate.

13. A ski binding moving mechanism according to claim 1, comprising:

a fastening element configured to be mounted fastened relative to the ski, where the rotatable element is fastened to the fastening element.

14. A ski binding moving mechanism according to claim 13, where the fastening element is configured to be detachably mounted on a forward part of an attachment plate configured to be attached to the ski.

15. A ski binding moving mechanism according to claim 14, where the attachment plate and the fastening element comprise respectively one or more first locking elements and one or more second locking elements, the first locking elements and the second locking elements engaging with each other and locking the fastening element in a longitudinal direction of the attachment plate and a lateral direction of the attachment plate when the fastening element is arranged from above and down onto the attachment plate.

16. A ski binding moving mechanism, according to claim 15, comprising:

a vertical lock configured to lock the one or more first locking elements and the one or more second locking elements to each other in the vertical direction.

17. A ski binding moving mechanism, according to claim 16, where the vertical lock comprises at least one pin configured to be mounted in the longitudinal direction of the attachment plate.

* * * * *